US008050595B2

(12) United States Patent
Wayman et al.

(10) Patent No.: US 8,050,595 B2
(45) Date of Patent: Nov. 1, 2011

(54) REPLENISHMENT CARRIER INJECTION SYSTEM

(75) Inventors: William H Wayman, Ontario, NY (US); David B Playfair, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 826 days.

(21) Appl. No.: 12/128,011

(22) Filed: May 28, 2008

(65) Prior Publication Data

US 2009/0162104 A1 Jun. 25, 2009

Related U.S. Application Data

(63) Continuation-in-part of application No. 11/960,258, filed on Dec. 19, 2007, now Pat. No. 7,974,557.

(51) Int. Cl.
*G03G 15/08* (2006.01)

(52) U.S. Cl. ..... 399/258; 399/259; 399/260

(58) Field of Classification Search ..... 399/258–260
See application file for complete search history.

(56) References Cited

U.S. PATENT DOCUMENTS 6,094,547 A 7/2000 Hart
2007/0053721 A1 3/2007 Matsumoto et al.

OTHER PUBLICATIONS

Feb. 22, 2011 Office Action issued in U.S. Appl. No. 11/960,258.

*Primary Examiner* — David Gray
*Assistant Examiner* — Erika J Villaluna
(74) *Attorney, Agent, or Firm* — Oliff & Berridge, PLC

(57) ABSTRACT

A replenishment carrier injection system is provided for adding carrier particles to a developer housing in a two-component developer toner imaging machine. The replenishment system includes (i) a carrier-only hopper for receiving and containing a first quantity of carrier particles; (ii) metering valves connected to a discharge end of the carrier-only hopper; (iii) a pneumatic plenum connected to the metering valves; (v) an air pump connected to the carrier-only hopper and to the pneumatic plenum for pressurizing the carrier-only hopper and for pneumatically conveying a metered quantity of carrier particles in an air stream from the pneumatic plenum; and (vi) carrier injection assemblies each being connected to the pneumatic plenum and including a conduit for carrier flow, a direct injector elbow connecting the conduit to a developer housing for directly injecting fresh carrier from the pneumatic plenum into the developer housing; and a fresh carrier current collector for detecting any fault in fresh carrier flow through said direct injector elbow the system into the developer housing.

15 Claims, 3 Drawing Sheets

REPLENISHMENT CARRIER INJECTION SYSTEM

RELATED APPLICATIONS

This application is a continuation-in-part of U.S. application Ser. No. 11/960,258 entitled "CARRIER REPLENISHMENT AND IMAGE MOTTLE REDUCTION SYSTEM", which in turn is related to U.S. application Ser. No. 11/960,295 entitled "TEETER-TOTTER VALVE FOR CARRIER REPLENISHMENT SYSTEM" and U.S. application Ser. No. 11/960,330 entitled "A TONER IMAGE REPRODUCTION MACHINE INCLUDING A BALL VALVE DEVICE HAVING A PRESSURE RELEASE ASSEMBLY" both filed Dec. 19, 2007, and having at least one common inventor.

BACKGROUND OF THE DISCLOSURE

The present disclosure relates generally to toner image reproduction machines, and more particularly, concerns such a machine utilizing two component (carrier particles and toner particles) developer, and including a replenishment carrier injection system.

In a typical toner image reproduction machine, for example an electrostatographic printing process machine contained within a single enclosing frame, an imaging region of a toner image bearing member such as a photoconductive member is charged to a substantially uniform potential so as to sensitize the surface thereof. The charged portion of the photoconductive member is irradiated or exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed at a development station by bringing a developer material in a developer housing into contact therewith. Generally, the developer material comprises magnetic carrier particles and toner particles that adhere triboelectrically to carrier particles. During development, the toner particles are attracted from the carrier particles to the latent image thereby forming a toner powder image on the photoconductive member. The toner powder image is then transferred from the photoconductive member to a copy sheet. The toner particles are then heated by a fusing apparatus within the single enclosed frame to permanently affix the powder image to the copy sheet.

Toner particles in the developer material in the developer housing accordingly become more and more depleted during image development as described above, ordinarily resulting in diminishing image quality. To maintain image quality, fresh toner particles therefore must be regularly added to the development. It has also been found that image quality, especial with respect to image mottle, can further also be improved by regularly also adding fresh carrier particles to the developer housing.

SUMMARY OF THE DISCLOSURE

Thus in accordance with the present disclosure, there has been provided a replenishment carrier injection system for adding carrier particles to a developer housing in a two-component developer toner imaging machine. The replenishment system includes (i) a carrier-only hopper for receiving and containing a first quantity of carrier particles; (ii) metering valves connected to a discharge end of the carrier-only hopper; (iii) a pneumatic plenum connected to the metering valves; (v) an air pump connected to the carrier-only hopper and to the pneumatic plenum for pressurizing the carrier-only hopper and for pneumatically conveying a metered quantity of carrier particles in an air stream from the pneumatic plenum; and (vi) carrier injection assemblies each being connected to the pneumatic plenum and including a conduit for carrier flow, a direct injector elbow connecting the conduit to a developer housing for directly injecting fresh carrier from the pneumatic plenum into the developer housing; and a fresh carrier current collector for detecting any fault in fresh carrier flow through the replenishment system into the developer housing.

BRIEF DESCRIPTION OF DRAWINGS

The foregoing and other features of the instant disclosure will be apparent and easily understood from a further reading of the specification, claims and by reference to the accompanying drawing in that:

DETAILED DESCRIPTION

Figure 1:
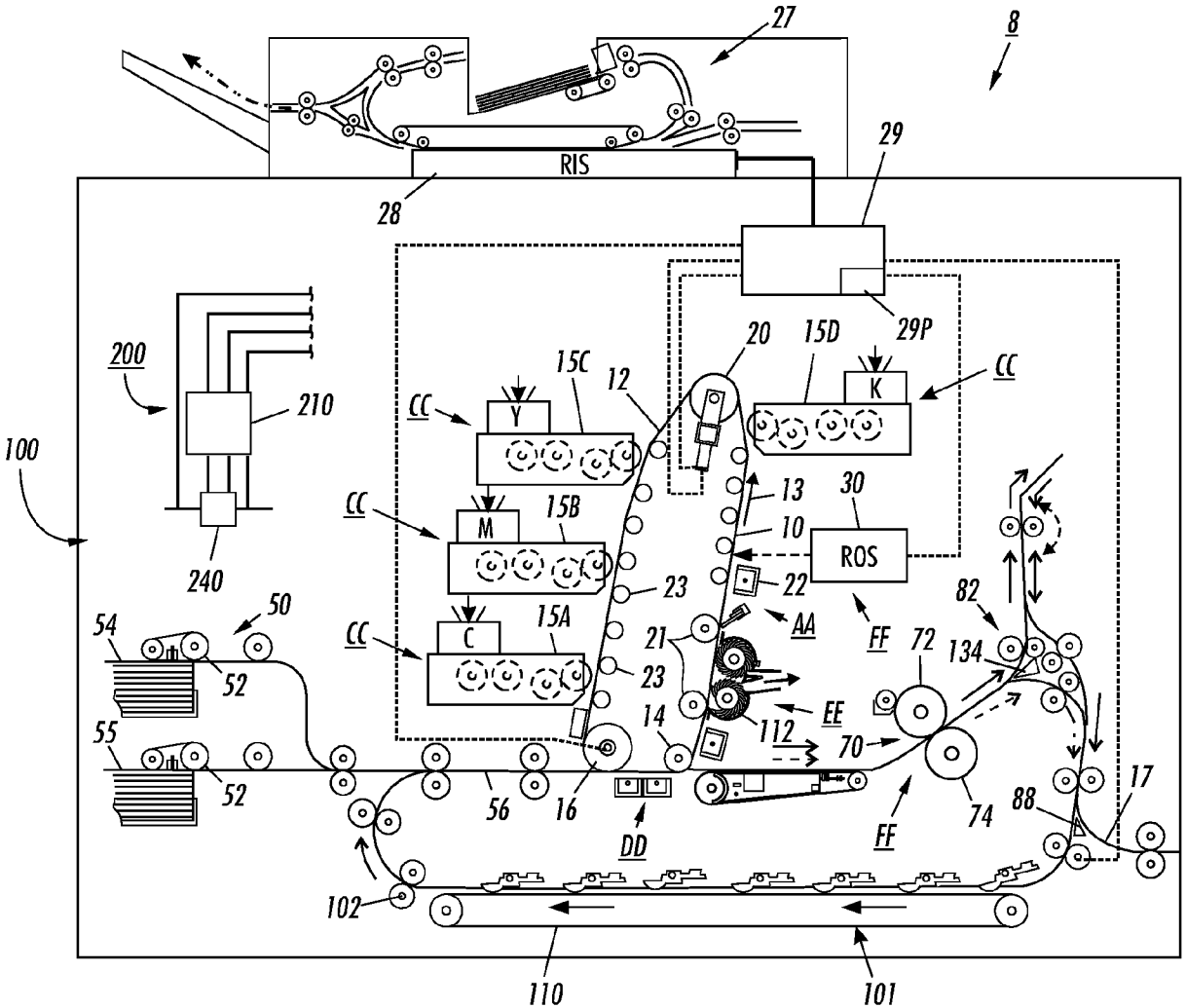
FIG. 1 is a schematic elevational view of the electrostatographic reproduction machine of the present disclosure including the replenishment carrier injection system in accordance with the present disclosure.

Referring first to the FIG. 1, it schematically illustrates an electrostatographic reproduction machine 8 that employs a photoconductive belt 10 mounted on a belt support module within a machine frame 11. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop about stripping roll 14, drive roll 16, idler roll 21, and backer rolls 23.

Initially, a portion of the photoconductive belt surface passes through charging station AA. At charging station AA, a charging wire of a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine component status information to be used for controlling operation of each such machine component.

Still referring to the FIG. 1, at an exposure station BB, the controller or electronic subsystem (ESS), 29, receives image signals from a raster input scanner (RIS) 28, representing a desired output image, and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve equally as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the portion of photoconductive belt 10 on a raster-by-raster basis.

After the electrostatic latent image has been recorded on photoconductive surface 12, belt 10 advances the latent image through development station CC, that includes four two-component developer housings 15A, 15B, 15C, 15D as shown, each containing in-use (being used) two-component developer material, for example two-component developer material consisting of carrier particles and tribo-electrically CMYK color toner particles, one color per developer housing. At each developer housing 15A, 15B, 15C, 15D the toner particles contained in the developer material that is in-use are appropriately attracted electrostatically to, and develop the latent image.

As pointed out above, in-use developer material (that is, the mix of carrier and toner particles) in each developer housing typically becomes depleted of toner particles over time as toner particles are attracted to, and develop more and more images. This is one cause of poor image quality. Fresh toner particles hence have to be frequently and controllably added to the developer housing. Another cause of poor image quality has been found to be aging carrier (to be addressed below in accordance to the replenishment carrier injection system of the present disclosure).

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top copy sheet 48 and advances it to sheet transport 56. Sheet transport 56 directs the advancing sheet 48 into image transfer station DD to receive a toner image from photoreceptor belt 10 in a timed manner. Transfer station DD typically includes a corona-generating device 58 that sprays ions onto the backside of copy sheet 48. This assists in attracting the toner powder image from photoconductive surface 12 to sheet 48. After transfer, sheet 48 continues to move in the direction of arrow 60 where it is picked up by a pre-fuser transport assembly 101 and forwarded by means of a vacuum transport 110 to a fusing station FF that includes a fuser assembly 70.

The fuser assembly 70 for example, includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roller 72 is internally heated by a quartz lamp (not shown).

The sheet 48 then passes through fuser assembly 70 where the image is permanently fixed or fused to the sheet. After passing through fuser 70, a gate 88 either allows the sheet to move directly via output 17 to a finisher or stacker, or deflects the sheet into the duplex path 101. Specifically, the sheet (when being directed into the duplex path 101), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 101, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed therefrom by a cleaning apparatus 112 at cleaning station EE.

Still referring to FIG. 1, after passing through the fusing apparatus 70, a gate 88 either allows the sheet to move directly via output 17 to a finisher or stacker (not shown), or deflects the sheet into the duplex path 101. Specifically, the sheet (when being directed into the duplex path 101), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 101, where that sheet will be inverted and then fed for recirculation back through the toner image forming module for receiving an unfused toner image on side two thereof.

Referring now to FIGS. 1-4, in order to improve image quality by reducing image mottle, the development station CC (of the electrostatographic image reproduction machine 8, with two-component developer housings 15A, 15B, 15C, 15D) includes the replenishment carrier injection system 200 of the present disclosure for adding fresh carrier particles to each of the two-component developer housings 15A, 15B, 15C, 15D. As pointed out above, it has been discovered that adding fresh carrier to a developer housing 15A, 15B, 15C, 15D (at a steady rate for example) further improves image quality, particularly with respect to image mottle.

The replenishment carrier injection system 200 of the present disclosure includes a central carrier-only hopper 210, a series of metering valves 220A, 220B, 220C, 220D for each metering a small amount of fresh carrier particles from the carrier-only hopper, carrier injection assemblies 225 including flexible tubing 230A, 230B, 230C, 230D, sensors S1, S2, and S3, fresh carrier current collectors S4, a controller 29, 29P, a linear air pump 240 for providing pressurized air 241 to transport the carrier particles in an air stream 231 in the flexible tubing, and direct injector elbows 250A, 250B, 250C, 250D for directly injecting carrier particles from the air stream 231 into the developer housings. The carrier-only hopper 210 is a large stationary container for holding at least 18 lbs of fresh carrier particles. The benefits of the system as such include flexibility in placing the carrier-only hopper and in sharing it among several developer housings, improved image quality (mottle), lower costs, and increased reliability.

More specifically, in the replenishment carrier injection system 200 a desired quantity of fresh carrier particles is metered from the pressurized storage carrier-only hopper 210 (a carrier-only hopper in the sense that there are no toner particles mixed with the carrier particles) through the metering valves 220A, 220B, 220C, 220D into the carrier injection assembly 225 that includes a pneumatic plenum consisting of an "inverted T" plenum 242A, 242B, 242C, 242D for each metering valve, a small diameter flexible, transport tube 230A, 230B, 230C, 230D that may be static-dissipative, a direct injector elbow 250A, 250B, 250C, 250D and the air pump 240.

As illustrated, each carrier injection assembly 225 comprises the linear air pump 240, an "inverted T" plenum 242A, 242B, 242C, 242D, a flexible transport tube 230A, 230B, 230C, 230D, and a direct injector elbow 250A, 250B, 250C, 250D. The linear air pump 240 operates at a pressure of about 0.36 PSI and results in an air flow of about 0.3 CFM through each transport tube of the carrier injection assembly. Advantageously, the linear air pump is quieter, lower in cost and uses less power than an air blower. The flexible transport tubes 230A, 230B, 230C, 230D each have about 0.170" ID and a length of about 10'. Each direct injector elbow 250A, 250B, 250C, 250D includes a turn 252 of about 90 degrees that has an inner surface 253, and includes a flow direction-changing strike surface 254 for carrier in the laden air stream 231 to strike. The flow direction-changing strike surface 254 as such forces the laden air stream 231 to flow towards the developer housing 15A, 15B, 15C, 15D.

Figure 2:
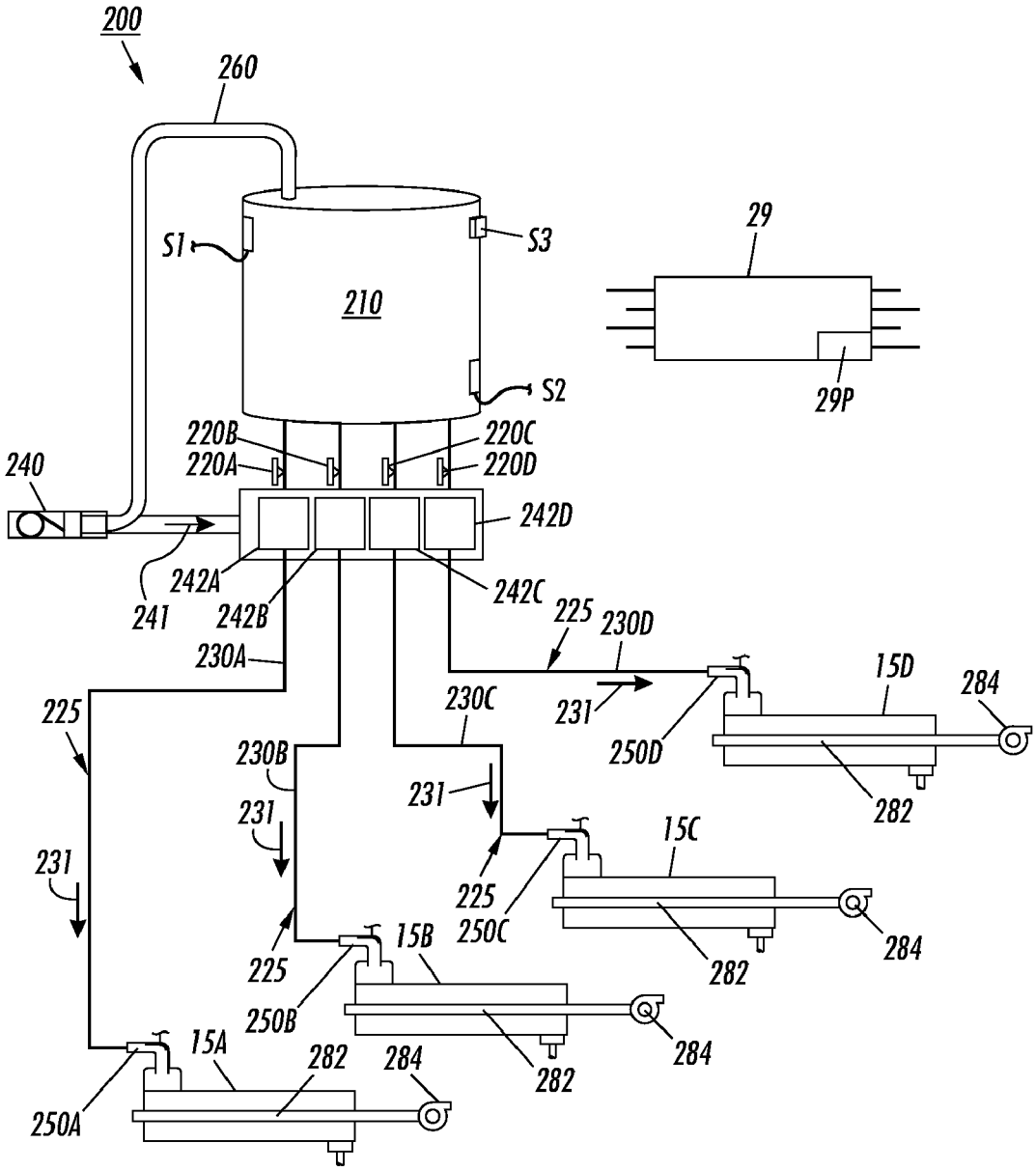
FIG. 2 is an enlarged schematic of the replenishment carrier injection system of the present disclosure.
Figure 3:
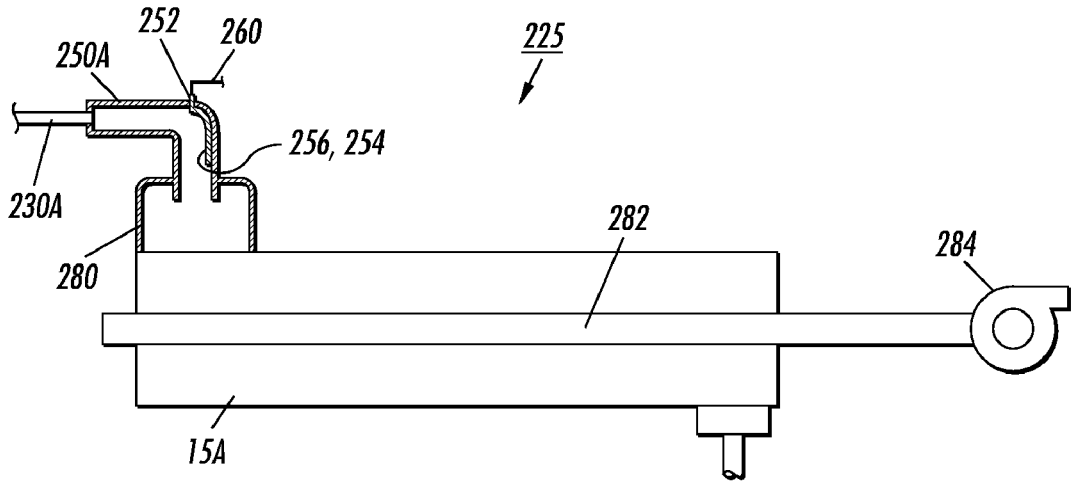
FIG. 3 is an enlarged schematic of a first embodiment of the carrier injector assembly of FIG. 2 in accordance with the present disclosure.
Figure 4:
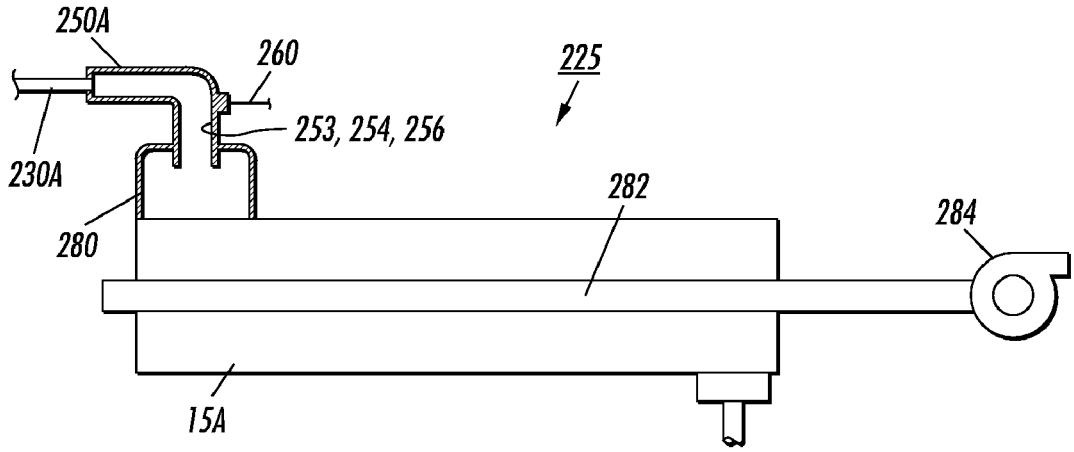
FIG. 4 is an enlarged schematic of a second embodiment of the carrier injector assembly of FIG. 2 in accordance with the present disclosure.

In a first embodiment of the direct injector elbow 250A, 250B, 250C, 250D as shown in FIGS. 2 and 3, each elbow may be made of a non-conductive material but includes an internal conductive strike plate 256 at the 90 degree turn 252 thereof. In such a case, the internal conductive strike plate 256 functions as the flow direction-changing strike surface 254. In a second embodiment as shown in FIG. 4, each elbow itself is made of a conductive material and so the inner surface 253 of the 90 degree turn 252 functions as the flow direction-changing strike surface 256. In each embodiment however, the conductive flow direction-changing strike surface 256 is connected to a charge/current conductor/wire 260 and then to the controller 29.

The fresh carrier current collector S4 is used by the controller as a throughput fault detector to sense if the system, particularly fresh carrier addition to the developer housing in accordance with the present disclosure, is working properly. The fresh carrier current collector S4 senses the turboelectric charge in the carrier striking the flow direction-changing strike surface 256. The strike surface 256 being located at the 90 degree turn 252 results in a better charge/current signal from the carrier than would locating it as a straight through conductive fitting because in a straight through fitting, a portion of the carrier will pass through the fitting without making contact with the fitting and therefore will not give up its electrical charge.

As further shown, the direct injector elbow 250A, 250B, 250C, 250D is also the last fitting in the carrier injector assembly 225, before the carrier enters the developer housing 15A, 15B, 15C, 15D. Using the direct injector elbow as such as the last fitting is important because it will detect all and any carrier flow faults in the system.

As also shown, the direct injector elbow 250A, 250B, 250C, 250D may be connected first into a feeder member 280 through which fresh toner is fed into the developer housing 15A, 15B, 15C, 15D, although at different times and at different rates from the fresh carrier being added in accordance with the present disclosure. In any case, the laden air stream 231 is directly deflected by the flow direction-changing strike surface 256 into the developer housing where the carrier mixes with developer (carrier and toner) within the developer housing, and the air flow (0.3 CFM) from the stream 231 becomes "airborne" within the developer housing.

In accordance with the present disclosure, such "airborne" air along with other air and dirt form the toner replenishment system are removed via a dirt collection manifold 282 and air exhaust system 284 that as shown, are connected to the developer housing 15A, 15B, 15C, 15D. The capacity of the air exhaust system 284 is about 15-20 CFM and so it easily handles the additional 0.3 CFM from the fresh carrier injection. Actual experiments have shown no significant increase in the load or emissions from the system when the developer housing has an additional 0.3 CFM carrier laden air stream injected into it.

As further illustrated, each developer housing 15A, 15B, 15C, 15D, includes a "trickle" port 270 for allowing overflow of in-use developer material. In this way the developer housing sump level remains constant even though fresh carrier is being added. The air pump 240 is connected to each of the "inverted T" plenums 242A, 242B, 242C, 242D for supplying a pressurized air stream 231 therethrough into the transport tube 230A, 230B, 230C, 230D and injector elbow 250A, 250B, 250C, 250D.

As shown, in a color image printing machine such as the machine 8 with a plurality of developer housings 15A, 15B, 15C, 15D, (that is, with a different developer housing 15A, 15B, 15C, 15D for each color toner e.g. CYMK color toners), the replenishment carrier injection system 200 has a separate transport assembly (metering valve, plenum, flexible tube and direct injector elbow) for each such developer housing 15A, 15B, 15C, 15D. Accordingly as shown, there are for example 4 different metering valves 220A, 220B, 220C, 220D; 4 different "inverted T" plenums 242A, 242B, 242C, 242D; 4 different small diameter tubes 230A, 230B, 230C, 230D; and 4 different direct injectors assemblies 250A, 250B, 250C, 250D.

As stated above, the carrier-only storage hopper 210 is pressurized, and can for example be maintained at the same air pressure level as the metering valves 220A, 220B, 220C, 220D and the transport tube 230A, 230B, 230C, 230D in order to eliminate any pressure drop across the metering valves 220A, 220B, 220C, 220D. This advantageously allows the metering valves 220A, 220B, 220C, 220D, to work by gravity and not be sensitive to any differential air pressure across the valves. Because of this, the carrier-only hopper 210 cannot be vented for long periods of time (longer than the time for refilling thereof) to atmospheric pressure because that will create a pressure difference across the metering valves, and thus block the gravitational flow of carrier through the valves.

The replenishment carrier injection system 200 as such effectively keeps the age of in-use carrier, i.e. the mean carrier residence time in each developer housing 15A, 15B, 15C, 15D, at a level below a predetermined failure point. This thereby assures a reduction in image quality problems such as image mottle. This is because at or near the predetermined "failure" point, image quality degrades rapidly with respect to streaks, mottle, and emissions related failures somewhere between 60 K and 120 K developer life.

As additionally illustrated, the replenishment carrier injection system includes a hopper fill point sensor S1; a hopper low carrier level sensor S3; a hopper low pressure sensor S2;

and fresh carrier current collectors S4 (4 of them) that form part of each direct injector elbow 250A, 250B, 250C, 250D. As shown in FIGS. 2 and 3, the fresh carrier current collector can be a conductive strike plate 254, or as shown in FIG. 4, each direct injector elbow 250A, 250B, 250C, 250D for example can be made from conductive material and is electrically isolated from ground and acts as a charge/current collector S4 for tribo-electric (static) charge created by the carrier that became charged by flowing in the air stream and rubbing against the inside of the transport tubes 230A, 230B, 230C, 230D.

In either case, a fresh carrier current collector S4 is provided in each direct injector elbow for collecting tribo-electric (static) charge current from charged carrier flowing through the direct injector to the developer housing 15A, 15B, 15C, 15D. The fresh carrier current collector S4 is connected to the controller 29, 29P and the current is measured by the replenishment control program 29P. This connection allows for detecting faults, such as clogging within any metering valve or tubing that does not allow carrier to arrive at the direct injector and hence into the developer housing as desired.

The fresh carrier replenishment program 29P for example utilizes inputs from the various sensors S1, S2, S3, S4 in the system as described above, and may include constant and variable rate fresh carrier replenishment software. Additionally it includes an enable/disable function for each developer housing 15A, 15B, 15C, 15D, with separate processor controlled variable dispense rates. This may be coupled with fault declarations for the presence/absence of fresh carrier particles arriving at the direct injector, detection of an empty hopper or hopper open to the atmosphere, and the appropriate actions for each condition. These functions may be integrated with developer housing motor operation so that if the developer housing motor is running, then and only then will the fresh replenishment carrier injection system be operational.

As can be seen, there has been provided a fresh replenishment carrier injection system for adding carrier particles to a developer housing in a two-component developer toner imaging machine. The replenishment system includes (i) a carrier-only hopper for receiving and containing a first quantity of carrier particles; (ii) metering valves connected to a discharge end of the carrier-only hopper; (iii) a pneumatic plenum connected to the metering valves; (v) an air pump connected to the carrier-only hopper and to the pneumatic plenum for pressurizing the carrier-only hopper and for pneumatically conveying a metered quantity of carrier particles in an air stream from the pneumatic plenum; and (vi) carrier injection assemblies each being connected to the pneumatic plenum and including a conduit for carrier flow, a direct injector elbow connecting the conduit to a developer housing for directly injecting fresh carrier from the pneumatic plenum into the developer housing; and a fresh carrier current collector for detecting any fault in fresh carrier flow through the replenishment system into the developer housing.

It will be appreciated that various ones of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A replenishment carrier injection system for adding fresh carrier particles to two-component developer housings, the replenishment carrier injection system including:

(a) a carrier-only hopper for receiving and containing a first quantity, of fresh carrier particles;

(b) metering valves connected to a discharge end of said carrier-only hopper for stopping and allowing flow of fresh carrier particles from said carrier-only hopper;

(c) a pneumatic plenum connected to said metering valves;

(d) an air pump connected to said pneumatic plenum for pneumatically conveying fresh carrier particles away from said pneumatic plenum; and (e) carrier injection assemblies each being connected to said pneumatic plenum and including a conduit for carrier flow, a direct injector elbow connecting said conduit to a developer housing for directly injecting fresh carrier from the pneumatic plenum into the developer housing; and a fresh carrier current collector for detecting any fault in fresh carrier flow through said direct injector elbow into said developer housing.

2. The replenishment carrier injection system of claim 1, wherein said air pump is connected to said carrier-only hopper for also pressurizing said carrier-only hopper.

3. The replenishment carrier injection system of claim 2, including a pressure sensor connected to said carrier-only hopper for assuring proper carrier flow from the carrier-only hopper through each of said metering valves.

4. The replenishment carrier injection system of claim 3, wherein said carrier-only hopper is pressurized to the same pressure level as each said metering valves.

5. The replenishment carrier injection system of claim 1, wherein said fresh carrier current collector comprises a turn of about 90 degrees including a carrier flow direction-changing strike surface.

6. A toner development station in an electrostatographic image reproduction machine for developing quality toner images having reduced image mottle, the toner development station comprising:

(a) two-component developer housings each containing in-use two-component developer material including toner particles and carrier particles; and (b) a replenishment carrier injection system for adding fresh carrier particles to said each two-component developer housings, the replenishment carrier injection system including:

(i) a carrier-only hopper for receiving and containing a first quantity of fresh carrier particles;

(ii) metering valves connected to a discharge end of said carrier-only hopper for stopping and allowing flow of fresh carrier particles from said carrier-only hopper;

(iii) a pneumatic plenum connected to said metering valves;

(iv) an air pump connected to said carrier-only hopper and to said pneumatic plenum for pressurizing said carrier-only hopper and for pneumatically conveying fresh carrier particles away from said pneumatic plenum; and (v) carrier injection assemblies each being connected to said pneumatic plenum and including a conduit for carrier flow, a direct injector elbow connecting said conduit to a developer housing for directly injecting fresh carrier from the pneumatic plenum into the developer housing; and a fresh carrier current collector for detecting any fault in fresh carrier flow through said direct injector elbow into said developer housing.

7. The toner development station of claim 6, wherein said air pump is connected to said carrier-only hopper for also pressurizing said carrier-only hopper.

8. The toner development station of claim 7, including a pressure sensor connected to said carrier-only hopper for assuring proper carrier flow from the carrier-only hopper through each of said metering valves.

9. The toner development station of claim 8, wherein said carrier-only hopper is pressurized to the same pressure level as each said metering valves.

10. The toner development station of claim 6, including a flexible air stream carrying tube connecting said pneumatic plenum to each said carrier direct injector elbows.

11. An electrostatographic image reproduction machine comprising:

(a) a moveable imaging member including an imaging surface;

(b) imaging means for forming a latent image on said imaging surface;

(c) a toner development station including two-component developer housings each containing in-use two-component developer material having toner particles and carrier particles for developing said latent images; and (d) a replenishment carrier injection system for adding fresh carrier particles to said each two-component developer housings, the replenishment carrier injection system including:

(i) a carrier-only hopper for receiving and containing a first quantity of fresh carrier particles;

(ii) metering valves connected to a discharge end of said carrier-only hopper for stopping and allowing flow of fresh carrier particles from said carrier-only hopper;

(iii) a pneumatic plenum connected to said metering valves;

(iv) an air pump connected to said carrier-only hopper and to said pneumatic plenum for pressurizing said carrier-only hopper and for pneumatically conveying fresh carrier particles away from said pneumatic plenum; and (v) carrier injection assemblies each being connected to said pneumatic plenum and including a conduit for carrier flow, a direct injector elbow connecting said conduit to a developer housing for directly injecting fresh carrier from the pneumatic plenum into the developer housing; and a fresh carrier current collector for detecting any fault in fresh carrier flow through said direct injector elbow into said developer housing.

12. The electrostatographic image reproduction machine of claim 11, wherein said air pump is connected to said carrier-only hopper for also pressurizing said carrier-only hopper.

13. The electrostatographic image reproduction machine of claim 12, including a pressure sensor connected to said carrier-only hopper for assuring proper carrier flow from the carrier-only hopper through each of said metering valves.

14. The electrostatographic image reproduction machine of claim 13, wherein said carrier-only hopper is pressurized to the same pressure level as each said metering valves.

15. The electrostatographic image reproduction machine of claim 11, including a flexible air stream carrying tube connecting said pneumatic plenum to each said carrier direct injector elbows.

* * * * *